US009028581B2

(12) United States Patent
Regenfuss et al.

(10) Patent No.: US 9,028,581 B2
(45) Date of Patent: May 12, 2015

(54) METHOD AND DEVICE FOR BREAKING UP ORE

(75) Inventors: Peter Regenfuss, Göttingen (DE); Andre Streek, Annaberg-Buchholz (DE)

(73) Assignee: Hochschule Mittweida (FH), Mittweida (DE)

( * ) Notice: Subject to any disclaimer, the term of this patent is extended or adjusted under 35 U.S.C. 154(b) by 0 days.

(21) Appl. No.: 13/824,088

(22) PCT Filed: Feb. 9, 2012

(86) PCT No.: PCT/DE2012/000134

§ 371 (c)(1), (2), (4) Date: Mar. 15, 2013

(87) PCT Pub. No.: WO2012/107027

PCT Pub. Date: Aug. 16, 2012

(65) Prior Publication Data

US 2013/0305879 A1 Nov. 21, 2013

(30) Foreign Application Priority Data

Feb. 10, 2011 (DE) ..... 10 2011 011 132

(51) Int. Cl.
*C22B 1/14* (2006.01)
*C22B 4/00* (2006.01)
(Continued)

(52) U.S. Cl.
CPC . *B02C 19/18* (2013.01); *C22B 4/00* (2013.01); *C22B 4/08* (2013.01); *C22B 1/00* (2013.01); *B02C 23/18* (2013.01); *C22B 1/14* (2013.01)

(58) Field of Classification Search
CPC ..... C22B 1/14; C22B 4/00; C22B 4/08; B02C 19/18; B02C 23/18
USPC ..... 75/10.13, 10.67; 241/1, 62
See application file for complete search history.

(56) References Cited

U.S. PATENT DOCUMENTS 5,824,133 A 10/1998 Tranquilla
7,476,829 B2 1/2009 Kingman
(Continued)

FOREIGN PATENT DOCUMENTS

DE 603 18 027 T2 11/2008
WO 2006/018771 A1 2/2006
WO 2009/101435 A2 8/2009

OTHER PUBLICATIONS

"electric current". Encyclopaedia Britannica, Encyclopaedia Britannica Online. Encyclopaedia Britannica Inc. Web. Dec. 5, 2014 <http://www.britannica.com/EBchecked/topic/182467/electric-current>.*

(Continued)

*Primary Examiner* — George Wyszomierski
*Assistant Examiner* — Tima M McGuthry Banks
(74) *Attorney, Agent, or Firm* — Michael Soderman

(57) ABSTRACT

The invention relates to methods and devices for breaking up ore. The methods and devices are characterized in particular in that ore mineral or ore minerals can be subsequently easily extracted. For this purpose coherent NIR radiation, non-coherent NIR radiation, at least one electric alternating field having a frequency greater than 300 GHz, at least one magnetic alternating field having a frequency greater than 300 GHz, at least one electromagnetic alternating field having a frequency greater than 300 GHz, or a combination thereof are respectively applied to the ore at least once by means of a device for generating the radiation, the at least one alternating field, or the radiation and the at least one alternating field, wherein ore mineral, ore minerals, absorbent components, or ore minerals and absorbent components of the ore absorb(s) energy from the radiation, the alternating field, or the radiation and the alternating field and said energy is not or is only slightly absorbed by the lode matter. Thus, advantageously, cracks are formed in the ore or the ore splits by means of the resulting stresses.

10 Claims, 3 Drawing Sheets

4a (can also be 4b, 4c, 4d or 4e)

(51) Int. Cl.

| | |
|---|---|
| ***B02C 19/18*** | (2006.01) |
| ***B02C 23/18*** | (2006.01) |
| ***C22B 4/08*** | (2006.01) |
| ***C22B 1/00*** | (2006.01) |

(56) References Cited

U.S. PATENT DOCUMENTS

| | | | | |
|---|---|---|---|---|
| 7,678,172 | B2 | 3/2010 | Batterham et al. | |
| 7,727,301 | B2 | 6/2010 | Shaw | |
| 8,240,480 | B2 * | 8/2012 | Shaw et al. | 209/11 |
| 2005/0092657 | A1 * | 5/2005 | Birken | 209/39 |
| 2012/0018550 | A1 * | 1/2012 | Goodes et al. | 241/25 |

OTHER PUBLICATIONS

"alternating current". Encyclopaedia Britannica. Encyclopaedia Britannica Online. Encyclopaedia Britannica Inc., 2014. Web. Dec. 5, 2014. <http://www.brittanica.com/EBchecked/topic/17601/alternating-current>.*

* cited by examiner 4a (can also be 4b, 4c, 4d or 4e)

METHOD AND DEVICE FOR BREAKING UP ORE

CROSS-REFERENCE TO RELATED APPLICATIONS

This application is the U.S. national stage of International Application No. PCT/DE2012/000134 filed on Feb. 9, 2012, and claims the benefit thereof. The application claims the benefit under 35 USC 119 of German Application No. 10 2011 011 132.8 filed on Feb. 10, 2011; all applications are incorporated by reference herein in their entirety.

BACKGROUND

The invention concerns methods and devices for breaking up ore.

A method of weakening the connection between a first material phase and a second material phase in rock or ore is disclosed in the publication DE 603 18 027 T2. wherein this is a method of microwave treatment of multi-phase materials. Further publications concerning a microwave treatment of rock or ore are U.S. Pat. No. 7,678,172 B2, U.S. Pat. No. 7,727,301 B2, U.S. Pat. No. 5,824,133 A, and WO 2009/11435 A2. In this connection, the rock or the ore is passed through a microwave cavity and heated thereby. This leads to weakening of the connection of the material phases causing cracks or weakening of their boundary surfaces. The use of the method is limited constructively to the microwave device. Moreover, an application of this method on site, this means during mining, is not possible.

These publications concern explicitly methods with electromagnetic alternating fields in the microwave range. The upper limit of the frequency spectrum is here maximally 300 GHz. It is to be assumed that this limit is deliberately selected because the adjoining spectrum of far infrared radiation has been considered to be disadvantageous because it leads quickly to surficial vitrification of the irradiated rock or to a glass-like removal that is very inert and therefore can no longer be decomposed by wet-chemical treatment.

DETAILED DESCRIPTION

The invention is based on the object of breaking up ore in such a way that ore mineral or ore minerals can be extracted subsequently.

This object is solved by the features disclosed in the claims.

The methods and devices for breaking up ore are characterized in particular in that the ore mineral or ore minerals can be simply extracted subsequently. For this purpose, the ore is loaded at least once to coherent NIR radiation, non-coherent HIR radiation, at least one electrical alternating field with a frequency greater than 300 GHz, at least one magnetic alternating field with a frequency greater than 300 GHz, at least one electromagnetic alternating field with a frequency greater than 300 GHz, or a combination thereof, by means of a device for generating the radiation, the at least one alternating field, or the radiation and the at least one alternating field, wherein ore mineral, ore minerals, absorbing components, or ore minerals and absorbing components of the ore absorb(s) energy from the radiation, the alternating field, or the radiation and the alternating field and the lode matter does not absorb, or absorbs only minimally, this energy. Accordingly, by means of the stress caused thereby cracks are advantageously generated in the ore or the ore splits up.

For this purpose, in a device for breaking up ore, at least one device, respectively, for generating coherent NIR radiation, non-coherent NIR radiation, at least one electrical alternating field with a frequency greater than 300 GHz, at least one magnetic alternating field with a frequency greater than 300 GHz, at least one electromagnetic alternating field with a frequency greater than 300 GHz, or a combination thereof is arranged at a spacing to the ore.

NIR is the known abbreviation for near infrared.

Advantageously, in this context, due to the minimal absorption of energy by the lode matter and the great absorption of energy by the ore mineral, the ore minerals and/or the further absorbing components of the lode matter in combination with a great penetration death, depending on the speed of heating of the minerals and the competing heat conduction in the lode matter, either the ore mineral phases are heat locally limited or a significant volume of the ore is heated so that accordingly the ore is worn down either specifically at individual points or unspecifically in the radiation-penetrated volume, but in both cases far-reaching and not only surficially.

Ore is to be understood as a metallic mineral or mineral mixture that is intermingled with the lode matter. Lode matter is in particular the rock which is intermingled with the mineral or the mineral mixture. Ore minerals are the minerals from which metal can be obtained. This includes also solid metal.

The further absorbing components are in particular localized absorbing components.

The methods and the devices are suitable in particular also for ores in which ore minerals in the lode matter are present in finely divided form, so-called "fine grain ore", wherein also ores with very hard lode matter can be broken up or split easily thereby.

A mineral or mineral mixture that evaporates during loading of the ore with the respective radiation and/or the respective alternating field can be removed with an apparatus, for example, a suction apparatus, as extracted mineral or mineral mixture. After condensation, the mineral or mineral mixture is available for further processing.

For further advantage resides in that the ore can be loaded on site, i.e., during mining, as well as in comminuted form at a treatment location with the respective radiation and/or the respective alternating field.

in the first case, the mining process is facilitated. For example, a laser beam can be directed in a targeted fashion across the surface of a rock exposure in order to remove only mineral-containing areas and to pick up the removed material by means of a suction apparatus or to selectively remove mineral as well as lode matter (or possibly in separate passes), carry it away with different suction nozzles from the mining site, and precipitate it in separate filters or condensers. This option of spatial separation of radiation source and application position enables possibilities of performing ore mining from a hermetically sealed station or from an appropriate vehicle and to therefore perform this work also In atmospheres with hostile living conditions or toxic atmospheres or underwater, i.e., under inert gas or, in the distant future, in an extraterrestrial area as well as at submarine sites.

In the second case, an alternating mechanical comminution with appropriate mills or breakers and loading with the respective radiation and/or the respective alternating field can be performed so that ore minerals or their reaction products can be extracted economically from the ore and thus separated from the lode matter. Loading of the respective ore with the respective radiation and/or the respective alternating field is advantageously' performable also alternatingly so that a substantially complete extraction of the ore minerals can be performed.

The principal mechanism of excitation by near infrared radiation differs substantiality from energy transmission through microwaves onto the ore. The ability to focus this radiation enables even in case of a focal length of several meters a power density (intensity) of the electromagnetic radiation of approximately 100 kW on a few square millimeters, in contrast to microwave treatment a laser beam source can therefore be positioned so as to be removed spatially far enough so that apparatus safety and occupational safety are ensured.

By utilizing the high radiation Intensities, on the one hand, movements of the beam or the ore material are required in order to process an economically feasible quantity of ore; on the other hand, the short and intensive irradiation generates especially the desired local shock effect that causes cracks and breakage in this connection, the size of the beam diameter and thus the intensity can be adjusted.

A further advantage resides in that the NIR radiation is absorbed by excitation of the electrons, in contrast to this, by microwave the lattice oscillations of the inorganic solids (ore) are excited. Accordingly, the energy transmission of NIR radiation onto the ore or onto specific minerals takes place by electronic excitation. The electronic excitation is significantly more selective relative to different components of the ore than the excitation of the lattice oscillations of the solid body.

A further advantage resides in that the ore that is to be broken up or to be separated from the gangue can also be located under water (or another liquid or solution) and loaded thereat with radiation. Beneficially, the radiation can be directed at an angle of less than 90 degrees onto the body or deposit from which the ore or the mineral is to be released. Advantageously, this medium is a flowing medium for transporting away the comminuted, decomposed or evaporated products freed from the gangue. in this connection, it is possible to operate with continuous radiation.

Advantageous embodiments of the invention are disclosed in the subordinate claims.

The cracked or split ore according to another embodiment is mechanically treated, in this connection, a comminution is carried out wherein known mills or breakers are employed.

Ore minerals of the ore that has been broken up by radiation and/or alternating field will be extracted subsequently according to a further embodiment.

In a further development this is done by extracting ore mineral by alkaline solutions, acids or solvents with or without complexing agents, chemical reaction of ore minerals by reaction with solids, liquids and/or gases, melting of ore minerals or reaction products of ore minerals with or without the aid of a metal or a flux agent or evaporation.

These are methods that are known and can be realized in an economically feasible way in order to extract the minerals and metals.

The ore according to another embodiment is cooled after or during loading with the radiation and/or the alternating field with a cooling device. The stresses that are caused thereby lead to further cracks in the ore or splitting of the ore, The ore in a further embodiment is sequentially or simultaneously loaded with different radiations and/or alternating fields with one or with different frequencies above 300 GHz. The introduced energy is accumulated in the ore so that further cracks or splits are caused.

According to that embodiment, pieces of the ore are supported on a earner. The latter is furthermore a component of a conveying device wherein the carrier is coupled to a drive mechanism.

The carrier is comprised of a material which does not absorb, or only minimally absorb, the radiations and/or the energy of the alternating fields.

The carrier In another embodiment is an area of the inner surface of a rotating cylinder or drum wall. In this context, the pieces of the ore are advantageously tumbled so that the energy is introduced optimally into the ore.

The carrier in a further embodiment is a component of a vibrating conveyor. The ore pieces that are arranged thereon are tumbled by means of vibrations so that an optimal energy introduction into the ore pieces is realized. The energy is introduced from several sides into the ore pieces.

In another variant, an apparatus for pieces of the ore and the device for generating coherent NIR radiation, non-coherent NIR radiation, the electrical alternating field with a frequency greater than 300 GHz, the magnetic alternating field with a frequency greater than 300 GHz, the electromagnetic alternating field with a frequency greater than 300 GHz, or a combination thereof are arranged such that the ore pieces, spaced relative to the device, are falling past it by the action of the normal force or by means of a blowing or centrifugal apparatus as an apparatus are blown past it or centrifugally moved past It at a spacing to the device. The ore pieces as they are failing or flying by or floating are irradiated wherein they are beneficially irradiated with several lasers/radiation sources as devices. When these pieces are larger pieces, it is advantageous to allow them to fail or fly by individually. These pieces are effectively broken up even when they are thicker than the effective depth of the radiation in the ore. These ore pieces are irradiated from several sides in this context.

Ore pieces moreover can be detected before reaching the irradiation zone by detectors with regard to direction of failing and speed; this enables a pulse-wise and energy-saving use of the respective source as the device. This pass is repeatable with simultaneous or intermediate blowing/carrying away of the fine fractions.

The material that is carried away by blowing or other intermediary or simultaneous sorting steps can be replaced in this connection continuously or stepwise by new ore pieces.

Blowing out or other types of removal of the material worn down by radiation can be enhanced in that the irradiated ore for example is swirled in an air, gas or liquid stream wherein by the resulting friction the worn-down proportion is extracted from the still massive residual grains. The removal action can be further expanded in that it can be utilized for selective separation of the grains in accordance with their size or their specific weight. In this way, sorting according to ore mineral contents is possible in principle.

In the beam path downstream of the source of coherent NSR radiation or non-coherent NIR radiation as a device for their generation, according to a further embodiment, a scanner is arranged so that the coherent NSR radiation or non-coherent NIR radiation by means of the scanner can be guided in a defined or stochastic way across the ore.

In another variant, one component of an exit optic system for the NIR radiation for ore to be broken up or to be extracted from the gangue in a fluid is a port that is transparent for the radiation. Moreover, the surface of the port that couples out the radiation is at least wetted by the fluid, A fluid is for example water so that ore that is contained in water can also be loaded with the NIR radiation. Accordingly, ore deposits located under water can be broken up also.

BRIEF DESCRIPTION OF THE DRAWINGS

One embodiment of the invention is illustrated in the drawings in principle and will be explained in the following in more detail.

The following are shown.

DETAILED DESCRIPTION OF THE PREFERRED EMBODIMENTS

In the following embodiment, methods and devices for breaking up ore will be explained together in more detail.

Figure 1:
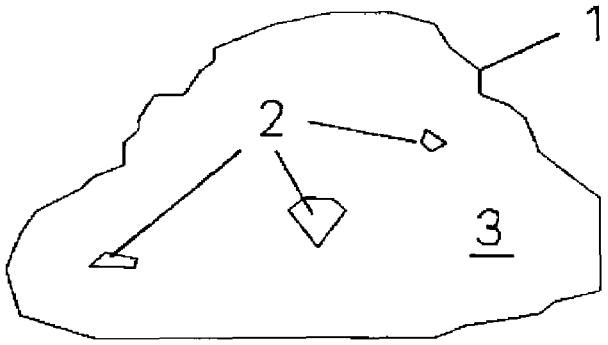
FIG. 1 shows an ore piece 1 with ore minerals and/or further absorbing components 2 in lode matter 3.

FIG. 1 shows an ore piece 1 with ore minerals 2 and/or further absorbent components 2 in lode matter 3 in a principal illustration.

A device for breaking up ore is comprised substantiality of at least one device for generating, respectively,

- coherent NIR radiation 4*a*,
- non-coherent NIR radiation 4*b*,
- at least one electrical alternating field 4*c* with a frequency greater than 300 GHz,
- at least one magnetic alternating field 4*d* with a frequency of greater than 300 GHz,
- at least one electromagnetic alternating field 4*e* with a frequency of greater than 300 GHz, or
- at least one combination thereof positioned at a spacing to the ore.

The ore is in this connection at least once treated with

- coherent NIR radiation 4*a*,
- non-coherent NIR radiation 4*b*,
- the electrical alternating field 4*c* with a frequency greater than 300 GHz,
- the magnetic alternating field 4*d* with a frequency of greater than 300 GHz,
- the electromagnetic alternating field 4*e* with a frequency of greater than 300 GHz, or
- at least one combination thereof by means of the respective at least one device.

Figure 2:
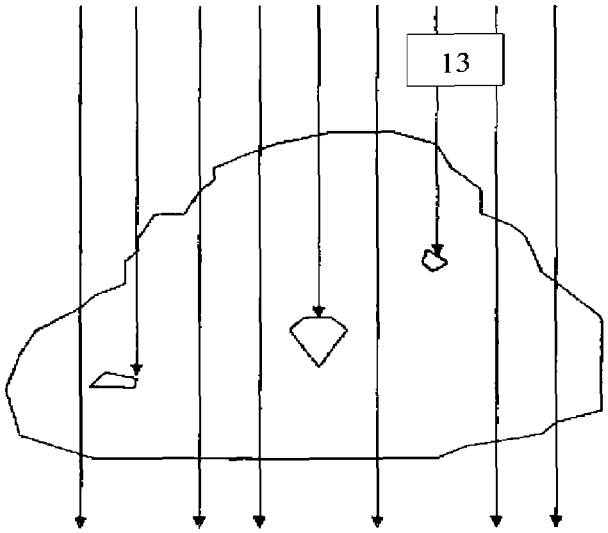
FIG. 2 shows the ore piece 1 with loading by NIR radiation or an alternating field, and a scanner 13 that can possibly be used.

FIG. 2 shows the ore piece 1 with loading by NIR radiation 4*a* or 4*b* or an alternating field 4 *c-e* in a principal illustration.

The ore mineral 2, the ore mineral mixture 2 and/or further absorbent components 2 of the ore absorb energy from the radiation 4 *a-b*, the alternating field 4 *c-e*, or the radiation 4 *a-b* and the alternating field 4 *c-e*, while the lode matter 3 does not absorb, or absorbs only minimally, this energy so that by means of the resulting stresses cracks 5 are generated in the ore or the ore splits apart.

Figure 3:
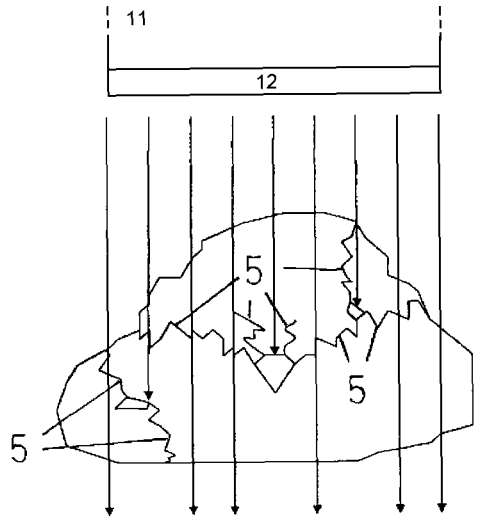
FIG. 3 shows an exit optic system 11 with a port 12 and the ore piece 1 with cracks.

The following are shown in connection with this:

FIG. 3 shows the ore piece 1 with cracks 5 and

Figure 4:
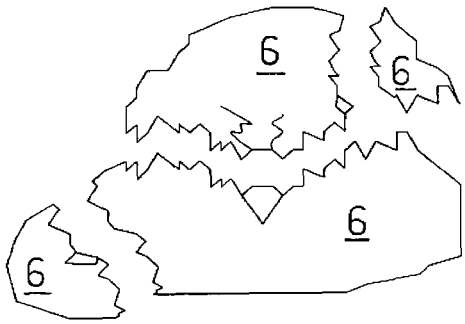
FIG. 4 shows the ore piece 1 with cracks and split-off pieces.
Figure 5:
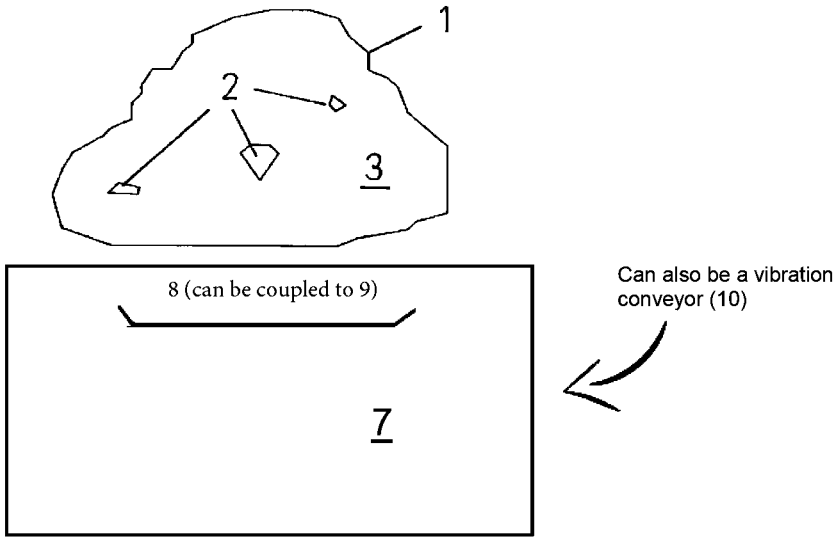
FIG. 5 shows ore pieces 1 located on a carrier 8—that could be connected to a drive mechanism 9, as a component of a conveying device 7, which could also be a vibration conveyor 10.

FIG. 4 shows the ore piece with cracks 5 and split pieces 6, each in a principal illustration.

Ore minerals 2 of the ore that is broken up with the radiation 4 *a-b* and/or the alternating field 4 *c-e* are subsequently extracted or subjected to a further mechanical treatment and extracted afterwards. This is done with known methods by

- extraction of the ore mineral 2 by alkaline solutions, acids, or solvents with or without complexing agents,
- chemical reaction of the ore mineral 2 by reaction with solids, liquids and/or gases,
- melting of the ore minerals 2 or their reaction products with or without the aid of another metal or a flux agent, or
- evaporation.

For loading the ore with a radiation 4 *a-b*, an alternating field 4 *c-e* or a combination thereof, the respective corresponding device as a source of the respective radiation 4 *a-b* or the device for generating the alternating field 4 *c-e* are positioned at a spacing to the ore in its respective form to be broken up.

In a first embodiment, the ore pieces 1 are for this purpose on a carrier. The latter is a component of a vibration conveyer or an area of the inner wall of a rotating tube or a rotating drum. By movements of the respective carrier, the ore pieces 1 are tumbled so that they are loaded from various sides with the radiation 4 *a-b* and/or the alternating field 4 *c-e*. When using coherent or non-coherent NIR radiation 4 *a-b*, a scanner Is provided In the beam path downstream of the corresponding source in the form of a laser so that the ore pieces 1 on the carrier are loaded in a defined or stochastic way, once or multiple times, by the radiation 4 *a-b*.

In a second embodiment, the apparatus for ore pieces 1 and the device for generating coherent NIR radiation 4*a*, non-coherent NIR 4*b*, the electrical alternating field with a frequency greater than 300 GHz, the magnetic alternating field with a frequency greater than 300 GHz, the electromagnetic alternating field with a frequency greater than 300 GHz, or at least a combination thereof are arranged such that the ore pieces 1 fall at a spacing relative to the device past it by the action of the normal force. During their flight the ore pieces 1 are loaded with the radiation 4 *a-b* or the alternating field 4 *c-e*. For this purpose, the ore pieces 1 are in an openable container above the respective device or are conveyed to the space above the respective device.

In a third embodiment, an apparatus for ore pieces 1 and the device for generating coherent NIR radiation 4*a*, non-coherent NIR radiation 4*b*, the electrical alternating field 4*c* with a frequency greater than 300 GHz, the magnetic alternating field with the frequency greater than 300 GHz 4*d*, the electromagnetic alternating field 4*e* with the frequency greater than 300 GHz, or at least a combination thereof are arranged such that the ore pieces 1 fly past the device at a spacing thereto. For this purpose, a known centrifugal apparatus is used. During their flight the ore pieces 1 are loaded with the radiation 4 *a-b* or the alternating field 4 *c-e*.

In a fourth embodiment, the irradiation is repeated once or several times wherein the ore after irradiation is swirled in a cyclone system. Advantageously, by friction the worn-down areas are released from the massive residue of the ore pieces 1 so that fractions with differently sized ore pieces 1 or different density are individually separable.

In a fifth embodiment, before irradiation with radiation 4 *a-b* above 300 GHz, the absorption of the ore for this radiation 4 *a-b* is modified by a radiating or reactive treatment.

The invention claimed is:

1. Method for breaking up ore, characterized in that the ore is loaded respectively at least once with coherent near infrared radiation (4*a*), non-coherent near infrared radiation (4*b*), at least one electrical alternating field (4*c*) with a frequency greater than 300 GHz, at least one magnetic alternating field (4*d*) with a frequency greater than 300 GHz, at least one electromagnetic alternating field (4*e*) with a frequency greater than 300 GHz, or a combination thereof, with a device, arranged at a spacing to the ore, that generates coherent near infrared radiation (4*a*), non-coherent near infrared radiation (4*b*), at least one electrical alternating field (4*c*) with a frequency greater than 300 GHz, at least one magnetic alternating field (4*d*) with a frequency greater than 300 GHz, at least one electromagnetic alternating field (4*e*) with a frequency greater than 300 GHz, or a combination thereof, wherein ore mineral (2), ore minerals (2), absorbing components (2), or ore mineral (2) and absorbing components of the ore absorbs or absorb energy from the coherent near infrared radiation (4*a*), the non-coherent near infrared radiation (4*b*), the at least one electrical alternating field (4*c*) with a frequency greater than 300 GHz, the at least one magnetic alternating field (4*d*) with a frequency greater than 300 GHz, the at least one electromagnetic alternating field (4*e*) with a frequency greater than 300 GHz, or a combination thereof and lode matter (3) does not absorb, or absorb only minimally, the energy so that, by means of resulting stresses, cracks 5 are generated in the ore or the ore splits apart, wherein the ore is sequentially or simultaneously subjected to loads selected from the group consisting of coherent near infrared radiation, non-coherent near infrared radiation, the electrical alternating field with a frequency greater than 300 GHz, the magnetic alternating field with a frequency greater than 300 GHz and the electromagnetic alternating field with a frequency greater than 300 GHz.

2. Method according to claim 1, characterized in that the cracked or split ore is mechanically treated.

3. Method according to claim 1, characterized in that the ore mineral (2) or ore minerals (2) of the ore broken up with the the coherent near infrared radiation (4*a*), the non-coherent near infrared radiation (4*b*), the at least one electrical alternating field (4*c*) with a frequency greater than 300 GHz, the at least one magnetic alternating field (4*d*) with a frequency greater than 300 GHz, the at least one electromagnetic alternating field (4*e*) with a frequency greater than 300 GHz, or a combination thereof are subsequently extracted.

4. Method according to claim 3, characterized in that the extraction of ore minerals (2) is done by extracting ore mineral (2) by agents selected from the group consisting of alkaline solutions, adds, solvents and complexing agents, chemical reaction of ore mineral (2) by reaction with agents selected from the group consisting of solids, liquids and gases, melting of ore minerals (2) or of reaction products of ore minerals (2), or evaporation.

5. Method according to claim 1, characterized in that the ore after or during loading is cooled with a cooling device.

6. Device for breaking up ore with the method according to claim 1, characterized in that, at a spacing to the ore, at least one device, respectively, that generates coherent near infrared radiation (4*a*), non-coherent near infrared radiation (4*b*), at least one electrical alternating field (4*c*) with a frequency greater than 300 GHz, at least one magnetic alternating field (4*d*) with a frequency greater than 300 GHz, at least one electromagnetic alternating field (4*e*) with a frequency greater than 300 GHz, or a combination thereof, is arranged so that ore mineral (2), ore minerals (2), absorbing components, or ore minerals (2) and absorbing components of the ore absorbs or absorb energy from the coherent near infrared radiation (4*a*), the non-coherent near infrared radiation (4*b*), the at least one electrical alternating field (4*c*) with a frequency greater than 300 GHz, the at least one magnetic alternating field (4*d*) with a frequency greater than 300 GHz, the at least one electromagnetic alternating field (4*e*) with a frequency greater than 300 GHz, or a combination thereof and lode matter (3) does not absorb, or absorbs only minimally, the energy, wherein stresses caused thereby cause cracks (5) in the ore or the ore splits up, wherein a scanner is arranged in a beam path downstream of a source of coherent near infrared radiation or non-coherent near infrared radiation as a device that generates coherent near infrared radiation or non-coherent near infrared radiation so that the coherent near infrared radiation or non-coherent near infrared radiation is guided by means of the scanner onto the ore.

7. Device according to claim 6, characterized in that pieces of the ore as ore pieces (1) are located on a carrier and in that the carrier is a component of a conveying device, wherein the carrier is coupled to a drive mechanism.

8. Device according to claim 7, characterized in that the carrier is a component of a vibration conveyor.

9. Device according to claim 6, characterized in that an apparatus for pieces of the ore and the device that generates the coherent near infrared radiation (4*a*), the non-coherent near infrared radiation (4*b*), the at least one electrical alternating field (4*c*) with a frequency greater than 300 GHz, the at least one magnetic alternating field (4*d*) with a frequency greater than 300 GHz, the at least one electromagnetic alternating field (4*e*) with a frequency greater than 300 GHz, or a combination thereof is arranged so that ore pieces (1), at a spacing to the device, fall past it by the action of a normal force or are blown or centrifugally thrown past it at a spacing to the device.

10. Device according to claim 6, characterized in that a component of an exit optic system for the coherent near infrared radiation or non-coherent near infrared radiation for ore to be broken up or to be separated from a gangue in a fluid is a port that is transparent for the coherent near infrared radiation or non-coherent near infrared radiation and in that a surface of the port that couples out the coherent near infrared radiation or non-coherent near infrared radiation is at least wetted by the fluid.

* * * * *